US005911538A

United States Patent [19]

Müller et al.

[11] Patent Number: 5,911,538

[45] Date of Patent: Jun. 15, 1999

[54] TRANSVERSE FORCE ROD BEARING

[75] Inventors: Erich Müller, Aarburg; Stephane Nancoz, Jongny, both of Switzerland

[73] Assignee: Pecon AG, Lostorf, Switzerland

[21] Appl. No.: 08/878,427

[22] Filed: Jun. 18, 1997

[30] Foreign Application Priority Data

Jun. 19, 1996 [CH] Switzerland ..... 1534/96

[51] Int. Cl.[6] ..... E01C 11/02

[52] U.S. Cl. ..... 404/60; 404/47; 14/73.1

[58] Field of Search ..... 404/60, 47, 56, 404/59, 62, 63, 73.1; 52/587.1; 264/273, 274

[56] References Cited

U.S. PATENT DOCUMENTS

| | | | |
|---|---|---|---|
| 2,194,718 | 3/1940 | Older | 404/60 |
| 2,494,869 | 1/1950 | Godwin | 404/60 |
| 2,572,552 | 10/1951 | Willard | 404/60 |

FOREIGN PATENT DOCUMENTS

| | | |
|---|---|---|
| 0032105 | 7/1981 | European Pat. Off. . |
| 0119652 | 7/1986 | European Pat. Off. . |
| 0193494 | 10/1988 | European Pat. Off. . |
| 0554483 | 8/1993 | European Pat. Off. . |

*Primary Examiner*—Thomas B. Will
*Assistant Examiner*—Raymond W. Addie
*Attorney, Agent, or Firm*—Pauley Petersen Kinne & Fejer

[57] ABSTRACT

A transverse force rod having at least one bearing cage disposed on both sides of a joint. Each bearing cage has a front plate and a trapezoidally shaped steel strip which is welded to the front plate. The transverse force rod is fixedly supported in one bearing cage, and a transverse force rod bearing sleeve is fixedly supported in the front plate of another bearing cage. The transverse force rod or the transverse force rod bearing sleeve penetrates the front plate and the steel strip of the one bearing cage or the other bearing cage.

8 Claims, 1 Drawing Sheet

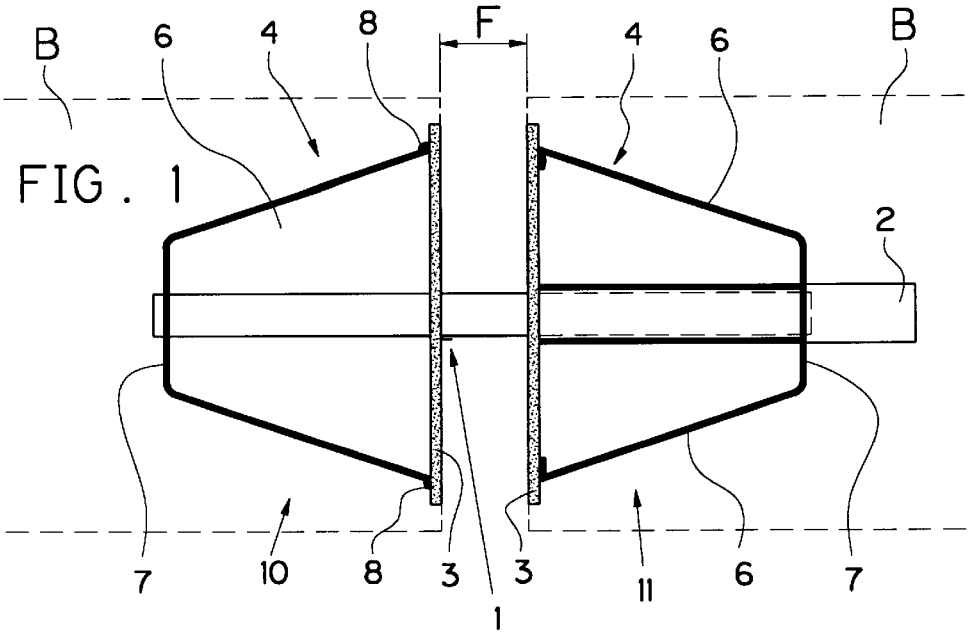
FIG. 1
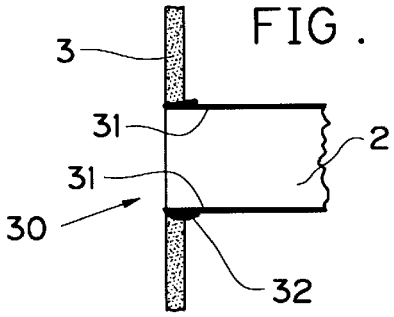
FIG. 2
FIG. 3
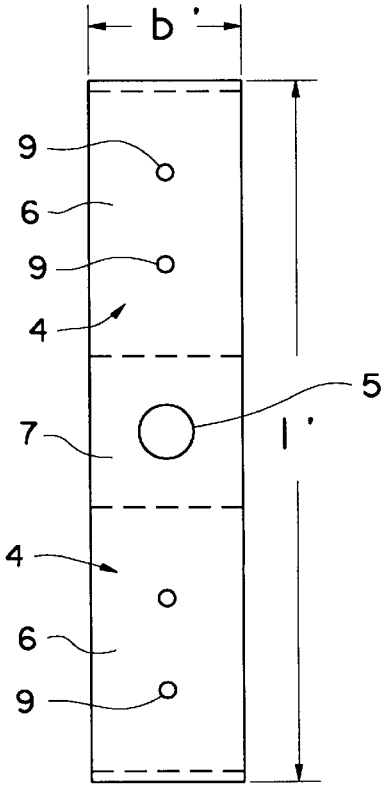
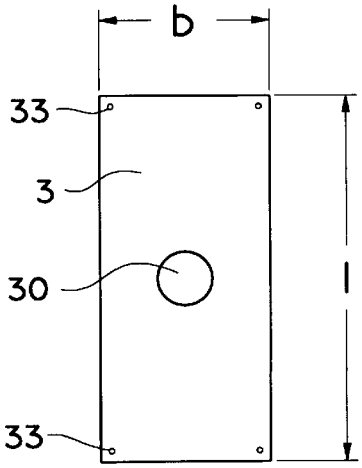
FIG. 4

TRANSVERSE FORCE ROD BEARING

BACKGROUND OF THE INVENTION

1. Field of the Invention

This invention relates to a transverse force rod bearing having a transverse force rod, a transverse force rod bearing sleeve and at least one bearing cage supporting the bearing sleeve, as well as a front plate disposed on the sides of a joint gap to be bridged.

2. Description of Prior Art

Conventional transverse force rods are connecting and pressure distributing elements for two structural concrete elements extending in the same general plane, which are separated from each other by a joint. A transverse force rod bearing is known from European Patent Publication EP-A-0 119 652, which consists of a transverse force rod, a transverse force rod bearing and a bearing cage supporting the bearing sleeve. Furthermore a front plate in the form of four brackets, arranged in a cross shape, is disposed on a side of a joint gap to be bridged. This front plate is merely used for fixing the transverse force rod bearing sleeve on a form while producing the concrete plate in which the bearing sleeve is encased. The bearing cage consists of a number of closed loops made of reinforcement steel wires with a bent hook projecting into the interior, in which the sleeve is seated. Thus the loops are located in planes which are parallel with a direction of extension of the joint.

Another conventional transverse force rod bearing is disclosed in European Patent Publication EP-A-0 193 494. In this embodiment the support of the transverse force rod bearing sleeve is independent of the bearing cage. Thus a mounting shoe is fastened at a front form, into which a front plate, which is fixedly connected with the transverse force rod sleeve, can be pushed. A height-adjustable support bar is provided at a closed end of the transverse force rod bearing sleeve, which assures correct support of the bearing sleeve when it is encased in concrete. The front plate only has a support function during the setting in concrete. The independent bearing cage has appropriate steel rings, in which both the sleeve and the transverse force rod are supported.

A multitude of other conventional transverse force rod bearings are known, in addition to the above-described transverse force rod bearing systems. One of the most important problems in connection with the transverse force rod bearing is that, although high-performance steel is available so that the occurring forces can be transmitted without problems, the pressure limit for concrete is considerably exceeded in an area of the transverse force rod or the transverse force rod bearing sleeve. Even though this problem can be resolved by increasing the number of transverse force rods in the running direction of the expansion joint, this results in considerably increased cost.

Furthermore, a conventional system of the Pflüger and Partners Company is known, wherein respectively two transverse force rods arc disposed vertically above each other. In tests, the danger of exceeding a pressure limit for concrete by this has been reduced by arranging anchor rods, disposed vertically with respect to the running direction of the transverse force rods, in a groove extending transversely to the running direction of two transverse force rod sleeves and connecting them. However, the surface increase achieved by this is relatively small, so that the mentioned problem is only slightly alleviated.

A system of the Aschwanden Company is furthermore known, in which the respective transverse force rod is held on one side in a cup, into which high-quality concrete is poured. Although the permissible pressure limit of concrete is exceeded inside the cup, force transfer takes place to the cup, and the concrete extending above the cup is relieved to the extent that here the permissible pressure limit is no longer exceeded. However, the seating problem of the transverse force rod or the transverse force rod sleeve during installation is considerably increased by this arrangement.

SUMMARY OF THE INVENTION

It is therefore one object of this invention to create a transverse force rod bearing having a transverse force rod, a transverse force rod bearing sleeve and at least one bearing cage supporting the bearing sleeve, as well as a front plate positioned on sides of a joint gap to be bridged, which avoids the previously mentioned problems.

This object is attained by means of a transverse force rod bearing as described in the following specification and the claims.

A preferred embodiment of the transverse force rod bearing in accordance with this invention is represented in the drawings and will be explained by means of the following description.

BRIEF DESCRIPTION OF THE DRAWINGS

FIG. 1 is a side view of an entire transverse force rod bearing in an uninstalled state, according to one preferred embodiment of this invention;

FIG. 2 is a partial sectional view of a bearing cage supporting a transverse force rod bearing sleeve, according to one preferred embodiment of this invention;

FIG. 3 is a front view of a strip of stainless steel, according to one preferred embodiment of this invention; and FIG. 4 is a top view of a front plate, according to one preferred embodiment of this invention.

DETAILED DESCRIPTION OF PREFERRED EMBODIMENTS

An area of an expansion joint F is located in a general area between two parallel front plates 3, which are positioned flush in the front faces of two concrete plates B to be connected. The two concrete plates B are only shown in dashed lines, since the entire transverse force rod bearing is represented in the uninstalled state in the drawings. The transverse force rod bearing comprises two bearing cages 10, 11, which are only connected with each other by means of a transverse force rod 1, which bridges the joint F. The transverse force rod 1 is supported in the bearing cage 10 on the left as shown in the drawing, and the transverse force rod bearing sleeve 2 is supported in the bearing cage 11 represented on the right as shown in the drawing. The front of the transverse force rod bearing sleeve 2, which will also be simply called a bearing sleeve 2 hereinafter, is shown in section and in the rear part in a plan view.

Each bearing cage 10, 11 comprises two parts which are fixedly connected with each other, namely the front plate 3 for one and a steel strip 4 for the other. The two front plates 3 are identical in their dimensions. The length l, as shown in FIG. 4, of each front plate 3 is less than a thickness of the concrete plate B in which the front plate 3 is installed. However, advantageously they will practically be made at least so long that they correspond to the thickness of the concrete plate B. The width of the front plate 3 is identified in FIG. 4 by dimension b. A steel strip 4 is fastened on the front plate 3. The steel strip 4 is fastened on the side of the front plate 3 facing away from the joint F. Fastening is preferably provided by welding. The unwound steel strip 4 is shown in FIG. 3. The width b' of the steel strip 4 is slightly less than the width b of the front plate 3. The length of the steel strip 4 is identified in FIG. 3 by 1'. A through-hole 5 is stamped out of a center of the steel strip 4, and has a diameter that corresponds to the diameter of the transverse force rod 1 or the diameter of the bearing sleeve 2, depending on whether the strip 4 is a part of the bearing cage 10, which supports the transverse force rod 1, or part of the bearing cage 11, which supports the bearing sleeve 2.

In a preferred embodiment the front plate 3 and the steel strip 4 together form a loop which is approximately trapezoidal in a side view. Thus the steel strips 4 have two legs 6 of the same length and extending toward each other, which are connected with each other by a section 7 extending parallel with the respective front plate 3. The through-holes 5 are centrally positioned in the respective sections 7. Several ventilation holes 9 are cut into each leg 6 of the steel strip 4. Each hole 9 prevents air from being trapped underneath the legs 6 when embedded in the concrete.

The steel strips 4 can be connected with the front plates 3 by welding seams 8 along the longitudinal edges of the legs 6, as shown in FIG. 1, in connection with the bearing cage 10. However, it is also possible to provide a folded section 12 at the ends of the legs 6, so that the connection between the front plate 3 and the steel strip 4 can be spot welded.

The transverse force rod 1 can be held interlockingly in the bearing cage 10 by means of an embodiment accurate to size of the through-hole 5 in the central section 7 of the steel strip 4, and a lead-through, equally accurate to size, of the transverse force rod 1 through the corresponding front plate 3. However, it is also possible to additionally fix the transverse force rod 1 in place on the steel strip 4 or the front plate 3 or on both elements. Such fixation can be performed, for example, with an adhesive or by spot welding.

Fastening of the bearing sleeve 2 on the bearing cage 11 preferably takes place in that the bearing sleeve 2 extends through the front plate 3 and terminates flush with the surface of the front plate 3 of the bearing cage 11. This is most clearly shown in FIG. 2. To this end the corresponding through-hole 30 is advantageously stamped out of the front plate 3. This results in a slightly conically extending hole, into which the sleeve 2 can be pushed. In this way a conically tapering annular gap 31 remains between the bearing sleeve 2 and the front plate 3, which makes easier welding of the bearing sleeve 2 and the front plate 3. In this case the circumferential weld seam is applied on the sides remote from the joint gap F. The weld seam itself is identified by element reference numeral 32, in FIG. 2. The bearing sleeve 2 is only passed through the steel strip 4, but is not fixedly connected with the steel strip 4.

This invention is not only simple in construction, but is also particularly advantageous statically or structurally. Because of the closed loop, which is formed by the front plate 3 and the steel strip 4, the construction can be statically heavily stressed. Furthermore, the pressure forces of the transverse force rod 1 or the bearing sleeve 2 are introduced in an optimal manner into the respective front plate 3 and into the steel strip 4. Therefore, not only the longitudinal section plane of the transverse force rod 1 or of the bearing sleeve 2 come to bear as the supporting surface, but the entire width of the steel strip 4 or of the front plate 3 come to bear as the supporting surface, so that the permissible concrete pressure is not exceeded. The width b of the front plate 3 or the width b' of the steel strips 4 are dimensioned as a function of the thickness of the concrete plates B and thus of the loads to be transferred.

Finally, the front plate 3 is of such dimensions that its length l is greater than the base of the trapezoidal loop, so that nail holes 33 can be cut into free corner areas of the front plate 3. This arrangement simplifies mounting of the bearing cages 11 on the boards of the plates to be poured.

What is claimed is:

1. In a transverse force rod bearing having a transverse force rod (1), a bearing sleeve (2), a first bearing cage (11) supporting the bearing sleeve (2), a first and a second front plate (3) each disposed on a respective side of a joint gap (F) formed between said front plates (3), the improvement comprising: said front plates (3) arranged on the respective sides of the joint gap (F), a first strip (4) fastened to said first front plate (3) and forming a first loop extending from said first front plate (3) in a first direction away from the joint gap (F) and forming said first bearing cage (11) that supports the bearing sleeve (2), and a second strip (4) fastened to said second front plate (3) and forming a second loop extending from said second front plate (3) in a second direction away from the joint gap (F) and forming a second bearing cage (10) that supports the transverse force rod (1).

2. In the transverse force rod bearing in accordance with claim 1, wherein at least one of the first loop and the second loop has an approximately trapezoidal shape wherein the respective one of the front plates (3) is a base.

3. In the transverse force rod bearing in accordance with claim 1, wherein at least one of the first strip (4) and the second strip (4) has a plurality of ventilation holes (9).

4. In the transverse force rod bearing in accordance with claim 3, wherein the ventilation holes (9) are cut into a plurality of obliquely extending legs (6) of at least one of the first loop and the second loop.

5. In the transverse force rod bearing in accordance with claim 1, wherein the bearing sleeve (2) is welded to said first front plate (3) which forms the first bearing cage (11).

6. In the transverse force rod bearing in accordance with claim 5, wherein the bearing sleeve (2) penetrates through said first front plate (3) and terminates flush at a face of said first front plate (3) that faces in a direction toward the joint gap (F).

7. In the transverse force rod bearing in accordance with claim 6, wherein said first front plate (3) has a hole (30) into which the bearing sleeve (2) projects.

8. In the transverse force rod bearing in accordance with claim 2, wherein at least one of the front plates (3) is longer than a length of the base of at least one of the first loop and the second loop, and in a plurality of free corner areas at least one of the front plates (3) has a plurality of nail holes (33).

* * * * *